US005386784A

United States Patent [19]

Meier

[11] Patent Number: 5,386,784

[45] Date of Patent: Feb. 7, 1995

[54] RAILROAD CAR HAND HOLD ASSEMBLY

[76] Inventor: Charles W. Meier, 3100 Canterbury La., Topeka, Kans. 66604

[21] Appl. No.: 73,167

[22] Filed: Jun. 7, 1993

[51] Int. Cl.[6] ..... E06C 5/00

[52] U.S. Cl. ..... 105/461; 105/326; 182/228

[58] Field of Search ..... 105/461, 326; 182/82, 182/83, 90, 93, 94, 106, 127, 228; 29/505, 521, 522.1, 525

[56] References Cited

U.S. PATENT DOCUMENTS

| | | | |
|---|---|---|---|
| 258,733 | 5/1882 | Ezard | 16/110 A |
| 779,774 | 1/1905 | Dunning | 182/90 |
| 791,742 | 6/1905 | Vogel | 105/461 |
| 1,149,368 | 8/1915 | Johnson | 182/90 |
| 1,170,390 | 2/1916 | Armstrong et al. | 182/228 |
| 2,194,349 | 3/1940 | Almdale | 182/228 |
| 2,395,612 | 2/1946 | Cremean | 29/148 |
| 2,511,077 | 6/1950 | Race | 182/228 |
| 2,951,550 | 9/1960 | Rich | 182/228 |
| 3,283,402 | 11/1966 | Larson | 182/228 |
| 3,633,862 | 1/1972 | Breen | 248/251 |
| 4,232,760 | 11/1980 | Becht et al. | 182/228 |
| 4,463,827 | 8/1984 | Sittner | 182/93 |
| 4,597,687 | 7/1986 | Colas | 182/228 |
| 4,698,896 | 10/1987 | Osterwald et al. | 182/228 |
| 4,702,349 | 10/1987 | Zenhausern | 182/90 |
| 4,765,659 | 8/1988 | Goubeaux et al. | 182/228 |
| 4,871,047 | 10/1989 | McLean | 182/90 |
| 4,935,638 | 6/1990 | Straka | 280/164.1 |
| 4,943,085 | 7/1990 | Straka | 280/770 |
| 5,139,295 | 8/1992 | Escobedo | 293/117 |

FOREIGN PATENT DOCUMENTS

| | | | |
|---|---|---|---|
| 2124502 | 11/1972 | Germany | 182/228 |
| 2254550 | 5/1973 | Germany | 182/90 |
| 0823838 | 11/1959 | United Kingdom | 182/228 |
| 1031401 | 6/1966 | United Kingdom | 182/228 |

*Primary Examiner*—Mark T. Le

*Attorney, Agent, or Firm*—Jones, Day, Reavis & Pogue

[57] ABSTRACT

A hand hold assembly and method for installation of the same on railroad car walls. The assembly has only three components, but can adapt to virtually any railroad car wall topography of the installation site. An elongated rod is bent or otherwise contorted and cut to fit the topography. Each end of the rod is mounted to the railroad car wall using one of two mounts, either a straight mount or an offset mount. If selected, the straight mount connects the end of the rod parallel to the railroad car wall, and the offset mount, if selected, connects the end of the rod perpendicular to the railroad car wall. The end of the rod is united to the selected mount by heating it, forging it into a bore of the mount and upsetting the end. Upon cooling, a steadfast union is formed. The new and improved assembly provides security and flexibility not before known in the art.

17 Claims, 3 Drawing Sheets

RAILROAD CAR HAND HOLD ASSEMBLY

FIELD OF THE INVENTION

The present invention relates in general to a hand hold assembly that is mounted on railroad cars. Railroad car hand holds must meet stringent safety standards, but also conform to the variable topographies of railroad cars. The present invention provides a hand hold assembly which can be adapted to conform to the various topographies of railroad car walls and at the same time satisfy applicable safety standards.

BACKGROUND OF THE INVENTION

The Federal Railroad Administration requires that railroad cars be equipped with hand holds on the top and side walls of railroad cars, so a person can safely maneuver about the railroad car. Hand holds are mounted on railroad cars in a variety of configurations to conform to the irregular topography of railroad car walls and to comply with applicable safety regulations. Hand hold configurations have permeated into scores of different hand hold designs.

Hand holds must be made of a reliable material, usually steel, for safety purposes. For the same reason, hand holds must be securely mounted to the exterior wall of the railroad car and be in a state of good repair. Detached or broken hand holds must be replaced immediately for the railroad car to operate without violating governmental safety regulations.

To keep all railroad cars operational, a railroad company must stock a matching replacement for every one of its uniquely configured hand holds which is in use. Railroad companies face inventory problems because hand holds come in a variety of configurations. Inventory problems include multiplied inventory, excessive storage space and exorbitant replacement costs.

Attempts have been made heretofore to mitigate inventory problems by providing hand hold assemblies for railroad cars having fewer components. U.S. Pat. No. 4,463,827 to Sittner employs an assembly of five different parts, and U.S. Pat. No. 4,871,047 to McLean employs an assembly with two different parts to minimize inventory. The present invention employs an assembly which has three different parts, but the new assembly offers much more versatility and security than the prior art assemblies.

Thus, an object of this invention is to provide an improved hand hold assembly which reduces the number of replacement parts necessary for an adequate reserve inventory.

Another object of the invention is to provide an improved hand hold assembly which is easily adaptable to installation on the variable surfaces of railroad cars.

A further object of the invention is to provide an improved hand hold assembly which securely connects the hand hold to the railroad car.

SUMMARY OF THE INVENTION

The disclosed assembly has three elements: a first mount, an elongated rod, and a second mount. The elongated rod is cut to an appropriate length and bent or otherwise contorted to a desirable configuration to conform to the topography of the installation site on the railroad car wall. The mounts are used to connect the ends of the rod to the railroad car wall. The ends of the rod are forged into the mounts which are in turn secured to the railroad car.

The mount used to connect each end of the rod to the railroad car preferably is selected from two alternatives consisting of an offset mount and a straight mount. The particular type of mount chosen is dependent upon the topography of the installation site on the railroad car and also the configuration mandated by the applicable governmental regulation. If the rod end is to be mounted perpendicular to the wall, the offset mount normally will be used for that end. If the rod end is to be mounted parallel to the wall, the straight mount will normally be used for that end.

The mount is preferably made from cast steel

The rod may be mounted by use of the same type of mount on each end, or by use of different mounts on either end. The type of mount selected for one end is independent of the type selected for the other end.

In accordance with this invention, only three different parts need be stocked in inventory: rods, straight mounts and offset mounts. This assembly offers versatility because each end of the rod may be mounted either perpendicular or parallel to the railroad car wall, irrespective of the other end, and the rod may be cut and bent to conform to the topography of the installation site. Therefore, the invented assembly can adapt to any of the countless topographies that are present on railroad car walls.

The ends of the rod are integrally interconnected or united with their respective mounts by heating the ends of the rod and forging them into bores of sockets in the mounts. While integrally interconnecting the heated end of the rod to the mount, the end is upset to provide a stronger union. The bore in each socket has an interior configuration that facilitates upset. Upset is achieved either by forcing the end of the rod to bend in the bore of the mount, or by swaging the end of the rod into the bore. After the rod is forged into the bore and allowed to cool, the bore provides a secure interconnection upon cooling.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
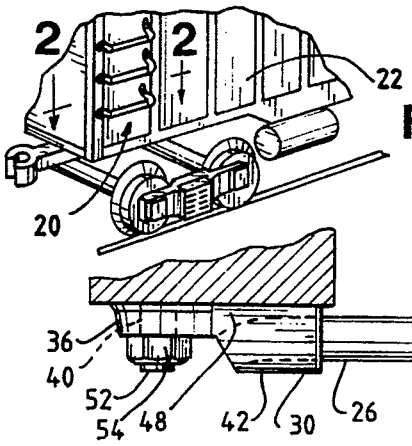
FIG. 1 is a perspective view of a hand hold assembly, in accordance with the present invention, connected to a wall of a railroad car.
Figure 2:
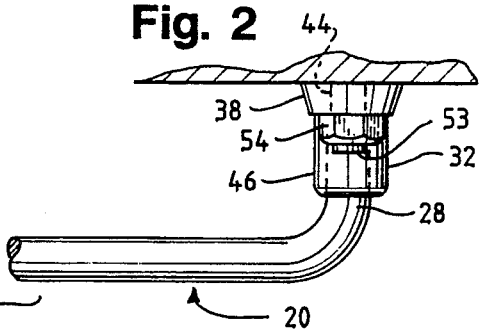
FIG. 2 is a top plan of the hand hold assembly of FIG. 1 taken along line 2—2 which shows that the rod is connected to the uneven wall by two different mounts, a straight mount and an offset mount.

A preferred embodiment of a new assembly for installing both hand holds on a wall of a railroad car is illustrated in FIGS. 1–17. FIG. 1 shows the new and improved hand hold assembly 20 in actual use on a railroad car wall 22. FIG. 2 is a top view and FIG. 3 is a plan view of the assembly 20 of FIG. 1.

Figure 3:
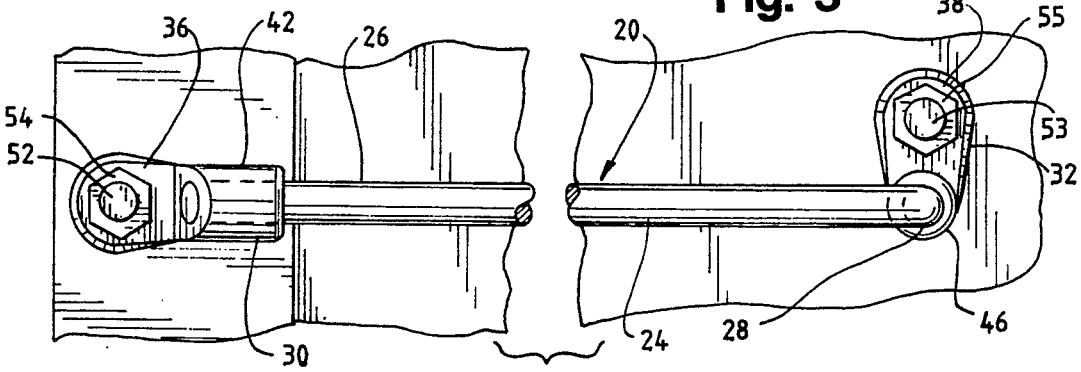
FIG. 3 is an elevational plan view of the hand hold assembly of FIG. 1.

FIGS. 2 and 3 show all three components of the assembly 20. Hence, the configuration of FIGS. 2 and 3 will be referred to initially to describe the invention. However, different configurations may be desirable, depending on the topography of the installation site on the railroad car wall 22 and other factors.

An elongated rod 24 has a first end 26 and a second end 28. The two ends 26, 28 of the rod 24 are connected to the wall of the railroad car via two mounts, 30 and 32. A straight mount 30 connects end 26 and an offset mount 32 connects end 26.

The rod 24 is preferably made of rolled steel, ASTM A-576, Grade 1015-1020, and preferably has a diameter of three-quarters inches. The rod 24 can be cut to an appropriate length and bent or otherwise contorted to a desired configuration to conform to any topography of the railroad car wall 22, as illustrated in the various embodiments illustrated herein.

In accordance with the present invention, one of two types of mounts 30, 32 is selected to connect each end 26 and 28 to the wall 22 of the railroad car. The type of mount 30, 32 selected for the first end 26 is selected independently of the mount 30, 32 selected for the second end 28.

Selection of the type of mount 30, 32 is dependent on the desired manner in which the end 26 or 28 is to be connected to the wall 22. When the first end 26 is connected parallel to the wall 22, a straight mount 30 is used, as shown in FIGS. 2 and 3. The straight mount 30 is clearly illustrated in FIGS. 4 and 5. Because the second end 28 is connected perpendicular to the wall 22, an offset mount 32 is used, as shown in FIGS. 2 and 3. The offset mount 32 is clearly illustrated in FIGS. 6 and 7.

Both types of mounts 30 and 32 are similar in several respects. They are both cast with AISI-1330 steel by any suitable method, such as sand casting. The steel should preferably have the mechanical properties set out in TABLE I.

TABLE I

| Mechanical Property Values | |
|---|---|
| Mechanical Property | Minimum Value |
| Tensile Strength (lb/in$^2$) | 90,000 |
| Yield Strength (lb/in$^2$) | 60,000 |
| Elongation (%) | 20 |
| Reduction of Area (%) | 40 |
| Brinell Hardness (BHN) | 180–220 |

The straight mount 30 has a support flange 36 which is used to connect the mount 30 to the railroad car wall 22. The offset mount 32 has a support flange 38 which is used to connect the mount 32 to the railroad car wall 22.

Figure 5:
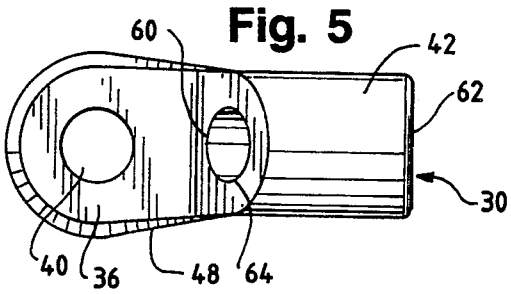
FIG. 5 is a plan view of the straight mount of FIG. 4.
Figure 4:
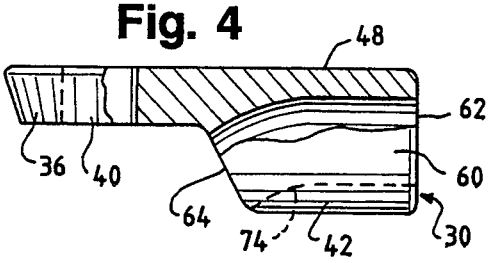
FIG. 4 is a partially cut-away side view of the straight mount of FIG. 1.
Figure 6:
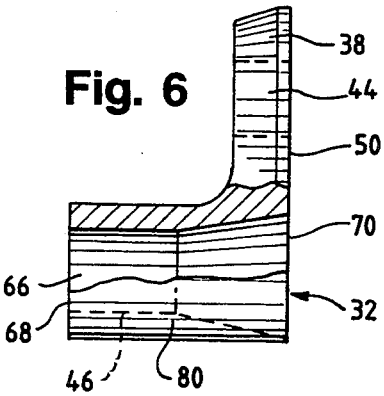
FIG. 6 is a partially cut-away side view of the offset mount of FIG. 1.
Figure 7:
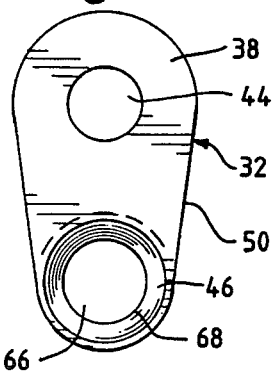
FIG. 7 is a plan view of the offset mount of FIG. 6.

As viewed in FIGS. 4 and 5, the flange 36 on the straight mount 30 is contiguous with a cylindrical socket 42. Said flange 36 defines an aperture 40. As shown in FIGS. 5–7, the flange 38 on the offset mount is contiguous with cylindrical socket 46. Said flange 38 defines an aperture 44.

The straight mount 30 has a base 48 sustaining the flange 36 and the socket 42. The offset mount 32 has a base 50 sustaining the flange 38 and the socket 46.

The straight mount 30 is connected to the wall 22 by placing the base 48 flush with the wall 22 and inserting a bolt 52 through the aperture 40 and through the wall 22 of the railroad car. The offset mount 32 is connected to the wall 22 by placing the base 50 flush with the wall 22 and inserting a bolt 53 through the aperture 44 and through the wall 22 of the railroad car. Standard nuts 54, 55 or equivalents can be used to secure bolts 52, 53 to the wall 22.

The cylindrical socket 42 is employed to integrally interconnect the end 26 of the rod 24 to the straight mount 30. The cylindrical socket 46 is employed to integrally interconnect the end 28 of the rod 24 to the offset mount 32.

On the straight mount 30, a cylindrical bore 60 extends all the way through the socket from an entry 62 to an outlet 64 as best illustrated in FIGS. 4–5. On the offset mount 32 as best illustrated in FIGS. 6–7, a cylindrical bore 66 extends all the way through the socket from an entry 68 to an outlet 70. The entry 62 of the bore 60 on the straight mount 30 and the entry 68 of the bore 62 on the offset mount 32 both have a diameter that is sufficiently large, preferably thirteen-sixteenths inches, to receive the end 26 and 28, respectively, of the rod 24.

The difference between the straight mount 30 and the offset mount 32 stems from the way the flanges 36 and 38 relate to the sockets 42 and 46, respectively. On the straight mount 30, the socket 42, and the bore 60 therethrough, is substantially parallel to the support flange 36. Hence, the end 26 of the rod 24 connected with the straight mount 30 is connected parallel to the wall 22 of the railroad car.

Whereas, the socket 46 on the offset mount 32, and the bore 66 therethrough, is perpendicular to the support flange 38. Consequently, the end 28 of the rod 24 is connected perpendicular to the railroad car wall 22 when the offset mount 32 is employed.

As seen in FIG. 4, the bore 60 in the straight mount 30 is not parallel to the support flange 36 all the way through from the entry 62 to the outlet 64. At a crook 74 within the bore 60 of the straight mount 30, the bore 60 bends unparallel to the flange 36 between the crook 74 and the outlet 64 of the bore 60. The angled outlet 64 is designed to effectuate an integral interconnection between the end 26 of the rod 24 and the straight mount 30.

The end 26 of the rod 24 is interconnected to the straight mount 30 by first heating it to a red-hot temperature of around 2000° F. At this hot temperature, the steel end 26 is relatively ductile. The hot end 26 is then forced into the bore 60 of the straight mount 30 past the crook 74 and into the outlet 64 of the bore 60. When the hot end 26 encounters the crook 74 in the bore 60, it bends to occupy the outlet 64. Upon cooling, the end 26 of the rod 24 and the straight mount 30 are integrally interconnected.

Turning to the offset mount 32, FIG. 6 shows that the socket 46 is perpendicular to the support flange 38. The bore 66 in the offset mount 32 is perpendicular to the flange 38 all the way through from the entry 68 to the outlet 70, but the diameter of the bore 66 is not uniform all the way through to the outlet 70. The diameter of the bore remains constant from the entry 68 to an intermediate point 80. The bore flares out from the intermediate point 80 to the outlet 70 of the bore 66. The outlet 70 is arranged to generate an integral interconnection between the end 28 of the rod 24 and the offset mount 32.

The end 28 of the rod 24 is integrally interconnected to the offset mount 32 similar to the method used for the straight mount 30. The end 28 is first heated to a red-hot temperature of around 2000° F. to obtain relative ductility. The hot end 28 is then forced into the bore 66 of the offset mount 32, all the way through, slightly beyond the outlet 70. A hammer or other means is used to swage the end 28 of the ductile hot steel rod 24 to fill most of the outlet 70. Upon cooling, an integral interconnection is forged between the end 28 of the rod 24 and the offset mount 32.

The description related to FIGS. 1–3 illustrates just one configuration of the handhold invention. One of the primary advantages of the present invention, however, is that several other configurations may be employed to conform to the topography of the railroad car wall 22. Other configurations are achieved by bending or otherwise contorting the rod 24 differently and substituting different mounts 30 or 32 for each end 26 and 28.

Figure 8:
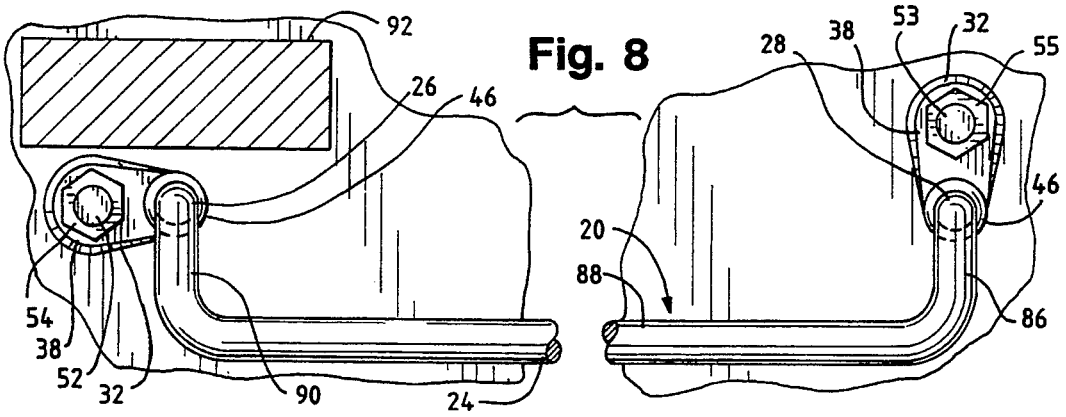
FIG. 8 is an elevational plan view of the hand hold assembly of the present invention where the rod is connected to a wall using two offset mounts with one mount being connected vertically and the other mount being connected horizontally.
Figure 9:
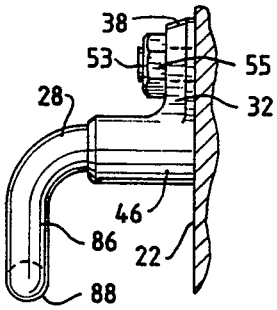
FIG. 9 is a side view of the of the vertically connected mount of FIG. 8.
Figure 10:
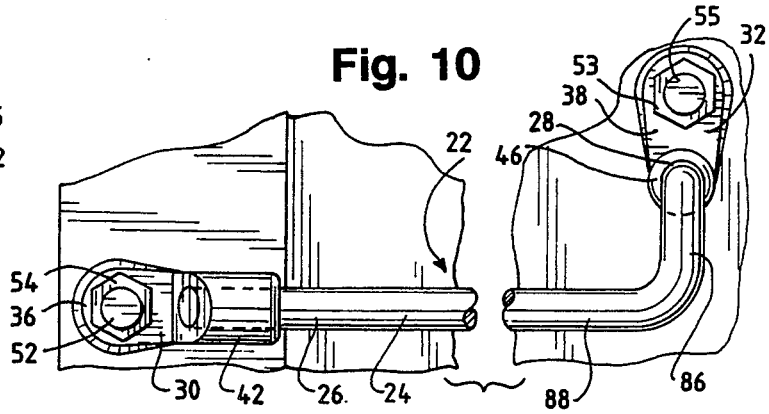
FIG. 10 is an elevational plan view of a rod connected to the wall with an offset mount and a straight mount.

FIGS. 8, 9 and 10 show one way that the rod 24 may be contorted when supported on the railroad car wall 22 by the offset mount 32. The end 28 is interconnected to the socket 46, so that the end 28 is perpendicular to the railroad car wall 22, as shown in FIG. 9. The end 28 is bent perpendicularly and downwardly to form a guard 86 which is parallel to the wall 22. The guard 86 then is bent laterally to form a rest 88. The rest 88 is also parallel to the wall 22, but perpendicular to the guard 86.

The rod 24 may extend from the guard 86 into a variety of configurations which may be either symmetrical as in FIG. 8 or asymmetrical as in FIG. 10. The other end 26 may be connected with an offset mount 32, as shown in FIG. 8, or a straight mount 30, as shown in FIG. 10.

In the symmetrical configuration shown in FIG. 8, the rest 88 is bent upward and perpendicular to form a second guard 90. The guard 90 is then bent toward and perpendicular to the wall 22 to form end 26 which is connected to the wall 22 with the offset mount 32.

The offset mount 32 can be rotated to a nonvertical position to connect the end 26 of the rod 24 to the wall 22, as shown in FIG. 8. Such a configuration is useful if an obstacle 92 prevents the end 26 from being vertically mounted to the wall 22.

Figure 11:
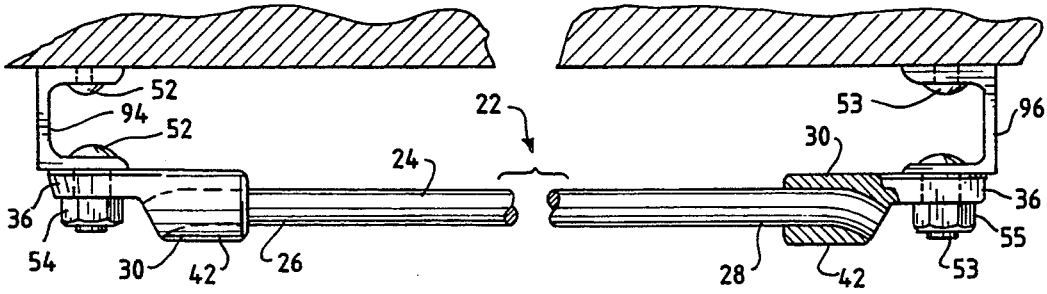
FIG. 11 is a top plan view of a hand hold assembly with each end of the rod connected with a straight mount to a stile of a ladder which is secured to a railroad car wall.
Figure 12:
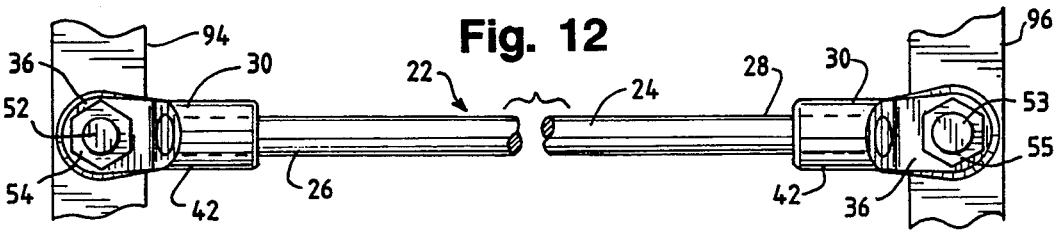
FIG. 12 is an elevational plan view of the assembly of FIG. 11.

Frequently, hand holds 20 are mounted in vertical series to form a ladder on the railroad car wall 22, as shown in FIG. 1. Alternatively, the end 26 of the rod 24 may be mounted to a stile 94. As shown in FIGS. 11 and 12, the stile is connected to the railroad car wall 22 by using any conventional means, such as a nut 54 (not shown) and bolt 52 assembly.

The end 28 may or may not be mounted to a stile 96 in the same manner. As shown in FIGS. 11 and 12, both ends 26 and 28 are connected to the stiles 94 and 96, respectively, using straight mounts 30 to form a ladder rung. A series of rods 24 can be so connected to form an entire ladder up the side of the railroad car wall 22.

Figure 13:
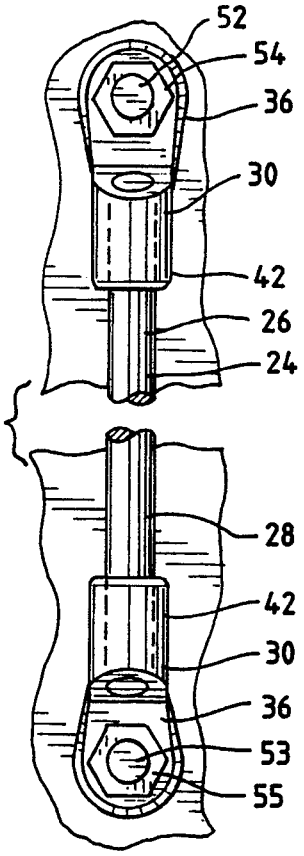
FIG. 13 is an elevational plan view of a hand hold assembly with each end of the rod vertically connected with a straight mount to the wall.

A rod 24 can be connected at both ends 26, 28 in a vertical configuration as shown in FIG. 13.

The configurations and uses offered by the present invention are numerous. The combination of one rod 24 and two mounts, which are each selected from two types of mounts 30 and 32, provides a hand hold assembly 20 that can virtually adapt to any topography of a railroad car wall 22 and meet any governmental regulation.

Figure 14:
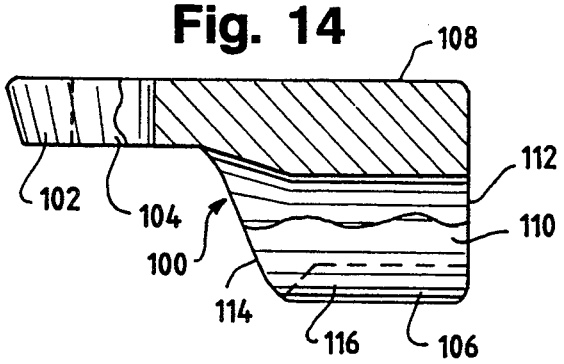
FIG. 14 is a partially cut-away side view of a modified straight mount.
Figure 15:
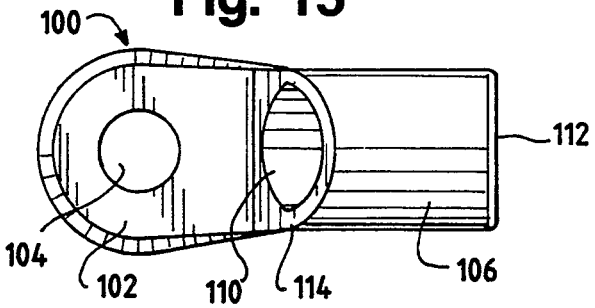
FIG. 15 is a plan view of the modified straight mount of FIG. 14.

It may be advantageous to substitute into the assembly 20 a modified straight mount 100, as shown in FIGS. 14 and 15. The modified straight mount 100 is substantially similar to the straight mount 30. It has a support flange 102, with an aperture 104 therethrough, for securing the straight mount 100 to the railroad car wall 22, and a socket 106 contiguous with said flange 102. A base 108 sustains the socket 106 and the flange 102.

The modified straight mount 100, however, has a bore 110 that is shaped like the bore 66 of the offset mount 32. The bore 110 has an entry 112 and an outlet 114. The bore 110 is parallel to the flange 102 all the way from the entry 112 to the outlet 114. The diameter of the bore 110 is large enough to receive an end 26 or 28 of the rod 24 and is constant from the entry 112 to an intermediate point 116. At the intermediate point 116, the bore 110 flares out to the outlet 114. The end 26 or 28 is interconnected to the modified straight mount 100 the same way as described for the offset mount 32, previously.

Figure 16:
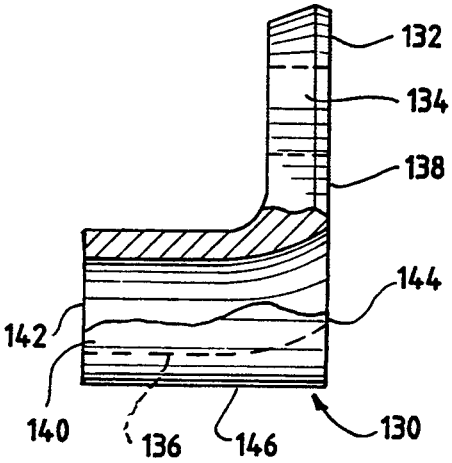
FIG. 16 is a partially cut-away side view of a modified offset mount.
Figure 17:
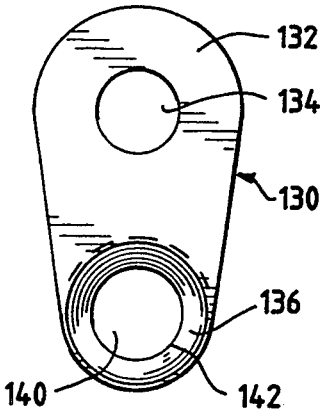
FIG. 17 is a plan view of the modified offset mount of FIG. 16.

Furthermore, it also may be advantageous to substitute into the assembly 20 a modified offset mount 130, as shown in FIGS. 16 and 17. The modified offset mount 130 is substantially similar to the offset mount 32. It has a support flange 132, with an aperture 134 therethrough, for securing the offset mount 130 to the railroad car wall 22, and a socket 136 contiguous with said flange 132. A base 138 sustains the socket 136 and the flange 132.

The modified offset mount 130, however, has a bore 140 that is shaped like the bore 60 of the straight mount 30. The bore 140 has an entry 142 and an outlet 144 and has a diameter large enough to receive an end 26 or 28 of the rod 24. The bore 140 is perpendicular to the support flange 136, between the entry 142 and a crook 146. From the crook 146 to the outlet 144, the bore 140 bends unperpendicular to the flange 132. The end 26 or 28 is interconnected to the modified offset mount 130 the same way as described for the straight mount 30, previously.

Either or both of these modified mounts 100 and 130 may supplant or supplement mounts 30 and 32 in a railroad company's replacement inventory for the disclosed assembly.

The invention has been described in detail with particular reference to preferred embodiments thereof. However, it will be understood that variations and modifications can be effected within the spirit and scope of the invention as described hereinabove and as set forth in the claims.

I claim:

1. A system including a wall and an assembly for installing a hand hold on said wall comprising:

an elongated rod having two ends;

said rod being structured and dimensioned to be cut to an appropriate length and to be contorted into a desired configuration;

a first mount and a second mount, each mount having a support flange with an aperture through which an attachment means is provided for securing said mount flush against an exterior portion of said wall and a cylindrical socket through which a bore extends, said bore being sufficiently large to receive one of said ends of said rod;

each of said ends of said rod including a forged part formed in said bore of said first and second mounts, respectively, to integrally interconnect said rod with said mounts; and said first mount and said second mount being independently selected from the group consisting of:

(a) an offset mount for connecting one of said ends perpendicular to said wall; and (b) a straight mount for connecting one of said ends parallel to said wall.

2. The system of claim 1, with said bore in said offset mount being perpendicular to a longitudinal axis through said flange, said bore having a constant diameter from an entry therein to a point at which said bore flares out to a diameter at an outlet therein which is greater than at said entry, one of said forged parts of said rod including a swaged portion in said outlet to integrally interconnect said one end to said offset mount upon cooling.

3. The system of claim 2, with said bore in said straight mount being parallel to a longitudinal axis through said flange from an entry therein to a crook in said bore, said bore being unparallel to said longitudinal axis through said flange from said crook to an outlet therein, one of said forged parts of said rod including a bent portion at said crook to integrally interconnect said one end to said straight mount upon cooling.

4. The system of claim 1, with said bore in said straight mount being parallel to a longitudinal axis through said flange from an entry therein to a crook in said bore, said bore being unparallel to said longitudinal axis through said flange from said crook to an outlet therein, one of said forged parts of said rod including a bent portion at said crook to integrally interconnect said one end to said straight mount upon cooling.

5. The system of claim 1, with said bore in said straight mount being parallel to a longitudinal axis through said flange, said bore having a constant diameter from an entry therein to a point at which said bore flares out to a diameter at an outlet therein which is greater than at said entry, one of said forged parts of said rod including a swaged portion in said outlet to integrally interconnect said one end to said straight mount upon cooling.

6. The system of claim 5, with said bore in said offset mount being perpendicular to a longitudinal axis through said flange from an entry therein to a crook in said bore, said bore being unperpendicular to said longitudinal axis through said flange from said crook to an outlet therein, one of said forged parts of said rod having a bent portion at said crook to integrally interconnect said one end to said straight mount upon cooling.

7. The system of claim 1, with said bore in said offset mount being perpendicular to a longitudinal axis through said flange from an entry therein to a crook in said bore, said bore being unperpendicular to said longitudinal axis through said flange from said crook to an outlet therein, one of said forged parts of said rod having a bent portion at said crook to integrally interconnect said one end to said straight mount upon cooling.

8. The system of claim 1, wherein said assembly is made of steel.

9. The system of claim 1, wherein said first end is connected with a straight mount to a stile which is fastened to said wall.

10. The system of claim 1, wherein one of said ends of said rod is connected to said wall with an offset mount, said rod extends away from said wall, bends perpendicular to said one end in a downward direction parallel to said wall to form a guard, said rod bends perpendicular to said guard but parallel to said wall in a direction generally toward said second mount to form a rest and another end is connected with said second mount to said wall.

11. The system of claim 10, wherein said rod, between said rest and said another end, bends perpendicular to said rest in an upward direction and parallel to said wall to form a second guard, said another end bends perpendicular to said second guard, but toward said wall and is connected to said wall with an offset mount.

12. A method for installing a hand hold to a wall comprising:

(a) taking a rod with two ends;

(b) bending said rod to a desired configuration;

(c) cutting said rod to a desired length;

(d) taking a first mount and a second mount both having a support flange with an aperture and a cylindrical socket through which a bore extends, each mount being independently selected from the group consisting of:

(1) an offset mount with a bore configured to connect one of said ends perpendicular to said wall; and (2) a straight mount with a bore configured to connect one of said ends parallel to said wall;

(e) heating one of said ends of said rod;

(f) forging said one end into said bore of said socket on said first mount;

(g) upsetting said one end in said bore on said first mount;

(h) cooling said one end to obtain an integral interconnection to said first mount;

(i) heating another end of said rod;

(j) forging said other end into said bore of said socket on said second mount;

(k) upsetting said other end in said bore on said second mount;

(l) cooling said other end to obtain an integral interconnection to said second mount;

(m) securing said first mount to said wall via an attachment means through said aperture in said flange of said first mount; and (n) securing said second mount to said wall via an attachment means through said aperture in said flange of said second mount.

13. The method of claim 12, including upsetting said one end by:

(a) providing a bore in said first mount which extends from an entry through a crook to an outlet, said bore between said crook and said outlet being positioned angular to said bore between said entry and said crook; and (b) bending said one end at said crook in said bore while said one end is forged into said bore.

14. The method of claim 12, including upsetting said one end by:

(a) providing a bore in said first mount which extends from an entry through an intermediate point to an outlet, said bore between said entry and said intermediate point having a constant diameter, and said bore flaring out from said intermediate point to a diameter at said outlet which is greater than at said entry; and (b) swaging said one end to occupy said outlet of said bore after said one end is forged into said bore.

15. The method of claim 13, including upsetting said other end:

(a) providing a bore in said second mount which extends from an entry through an intermediate point to an outlet, said bore between said entry and said intermediate point having a constant diameter, and said bore flaring out from said intermediate point to a diameter at said outlet which is greater than at said entry; and (b) swaging said other end to occupy said outlet of said bore after said other end is forged into said bore.

16. The method of claim 13, including upsetting said other end by:

(a) providing a bore in said second mount which extends from an entry through a crook to an outlet, said bore between said crook and said outlet being positioned angular to said bore between said entry and said crook; and (b) bending said other end at said crook in said bore while said other end is forged into said bore.

17. The method of claim 14, including upsetting said other end by:

(a) providing a bore in said second mount which extends from an entry through an intermediate point to an outlet, said bore between said entry and said intermediate point having a constant diameter, and said bore flaring out from said intermediate point to a diameter at said outlet which is greater than at said entry; and (b) swaging said other end to occupy said outlet of said bore after said other end is forged into said bore.

* * * * *